US007874755B2

(12) United States Patent
Erh

(10) Patent No.: US 7,874,755 B2
(45) Date of Patent: Jan. 25, 2011

(54) ROLLER FOR SELECTIVELY APPLYING PAINT AT SURFACE CORNERS

(76) Inventor: Poh Soon Erh, Block 954 Hougang Ave 9, #12-526, Singapore (SG) 530954

( * ) Notice: Subject to any disclaimer, the term of this patent is extended or adjusted under 35 U.S.C. 154(b) by 1072 days.

(21) Appl. No.: 10/599,056

(22) PCT Filed: Mar. 22, 2005

(86) PCT No.: PCT/SG2005/000089

§ 371 (c)(1),
(2), (4) Date: Sep. 19, 2006

(87) PCT Pub. No.: WO2005/097355

PCT Pub. Date: Oct. 20, 2005

(65) Prior Publication Data

US 2008/0050532 A1 Feb. 28, 2008

(30) Foreign Application Priority Data

Apr. 8, 2004 (SG) ..... 200401978-2

(51) Int. Cl.
*B43M 11/02* (2006.01)

(52) U.S. Cl. ..... 401/219; 401/197; 15/230.11

(58) Field of Classification Search ..... 401/196, 401/197, 208, 218, 219, 220; 492/27; 15/230.11
See application file for complete search history.

(56) References Cited

U.S. PATENT DOCUMENTS 1,546,529 A * 7/1925 Wuelker ..... 15/104.93
2,836,840 A * 6/1958 Pratt ..... 15/230.11
3,933,415 A * 1/1976 Woolpert ..... 401/145

* cited by examiner

*Primary Examiner*—David J Walczak
(74) *Attorney, Agent, or Firm*—John Paul Young

(57) ABSTRACT

A frustoconically-shaped paint roller (210) to selectively apply paint to surfaces and surface corners. The paint roller has a rolling guide (280) that permits the roller to rotate eccentrically so as to accommodate rough or uneven surfaces. A circular integral guard (260) of predetermined diameter is present to prevent the user from applying excessive force when using the roller and squeezing paint from the roller. When used correctly, the integral guard does not contact the surface to be painted. One embodiment of the invention has a chamber (270) to store paint so that the repeated frequent charging of the roller with paint from a can or tray is avoided.

11 Claims, 6 Drawing Sheets

ROLLER FOR SELECTIVELY APPLYING PAINT AT SURFACE CORNERS

FIELD OF THE INVENTION

The present invention relates to apparatuses for applying fluids such as, paint, onto surfaces. In particular, the present invention relates to a paint roller for selectively applying paint at surface corners.

BACKGROUND OF THE INVENTION

Paint rollers for applying paint onto surfaces are known. Typically, such paint rollers have paint-absorbing surfaces that are dipped into paint containers and then rolled over surfaces that are to be painted. Another type of paint rollers has a permeable surface through which paint, stored inside such paint rollers, can flow through for application onto surfaces that are to be painted.

Generally, existing paint rollers works well for a flat, even surface on which only a single paint shade or color is to be applied. However, a problem arises when such paint rollers are used to apply paint at surface corners formed, for example, by two walls or between a wall and a ceiling. This is a problem because paint desired on one surface may be undesirably applied onto an adjacent surface.

Prior art paint rollers that alleviate the above problem include U.S. Pat. No. 5,623,740, issued to Burns et al., in which an apparatus provides a shield that acts as a barrier to paint being applied onto an adjacent surface. Such prior art paint rollers provide shield-like barriers that are detachably mounted to the paint rollers. However, use of the shield-like barriers causes other problems. For example, the barrier may be required to contact an adjacent surface for alignment purposes and presents a problem when an adjacent surface has wet paint or is delicate. Consequently, the adjacent surface can be damaged or abrasion by contact with the guard. Furthermore, shield-like barriers or guards are accessories that typically require assembling or attaching, which adds complexity to prior art paint rollers.

Another problem is that an uneven or rough painting surface will cause the users of prior art paint rollers to skip certain areas of the surface, given the inherent rigidity of the paint rollers.

Yet another problem, common to all paint rollers, is that application of an overly heavy force in use will contribute to excessive paint being squeezed out, resulting in an undesirably thick coat of paint.

The present invention superficially resembles an earlier invention (PCT/SG03/00015) by the same inventor, Mr Poh Leong Er. That earlier invention has been deemed to be inventive over other inventions such as NL 8301130 (Shuler JP), CA 2101124 (Bazydlo S), U.S. Pat. No. 5,412,832 (Irven N), and GB 2143158 (Multigood BV) by the WIPO examiner.

However, the earlier invention (PCT/SG03/00015) by Mr Er also suffers, to a degree, some of the problems of the prior art inventions.

Therefore, a need clearly exists for a novel paint roller for selectively applying paint at surface corners and that does not need separate accessories such as a barrier or a guard to be assembled or attached. In addition, a means to minimize excessive application of force when using the paint roller will also be desirable.

SUMMARY OF THE INVENTION

The present invention seeks to provide an apparatus and method for applying paint to surfaces and surface corners.

Accordingly, in one aspect, the present invention provides a paint roller for applying paint onto a surface comprising a frustoconically-shaped applicator having a coupler end; a distal end; an external surface between the coupler end and the distal end; a paint-absorbable member; a circular integral guard disposed at the coupler end; and a rolling guide disposed at the distal end.

In another aspect, the present invention provides a method of selectively applying paint onto surfaces and surface corners, the method comprising using a paint roller comprising a frustoconically-shaped applicator, a circular integral guard and a rolling guide, whereby the circular integral guard prevents a paint-absorbable surface mounted on the applicator from being excessively compressed, and the rolling guide permits paint to be applied to even surfaces and surface corners.

BRIEF DESCRIPTION OF THE DRAWINGS

A preferred embodiment of the present invention will now be more fully described, by way of example, with reference to the drawings of which:

FIG. 5 is a lateral view showing how the present invention is able to accommodate even surfaces, while

DETAILED DESCRIPTION OF THE DRAWINGS

A detailed description of the present invention will now be given in accordance with the preferred embodiments of the invention. In the following description, details are provided to describe the preferred embodiments. It shall be apparent to one skilled in the art, however, that the invention may be practiced without such details. Some of these details may not be described at length so as not to obscure the invention.

There are many advantages of the preferred embodiment of the invention. One advantage of the preferred embodiment is that paint may be applied to surface corners with precision, without damage to the surface as a barrier or shield is not needed.

Another advantage is that an inventive means of the present invention allows paint to be applied to uneven or rough surfaces.

Yet another advantage is that excessive force when applying paint is reduced, so that thin, even coats of paint may be applied to a surface.

Figure 1:
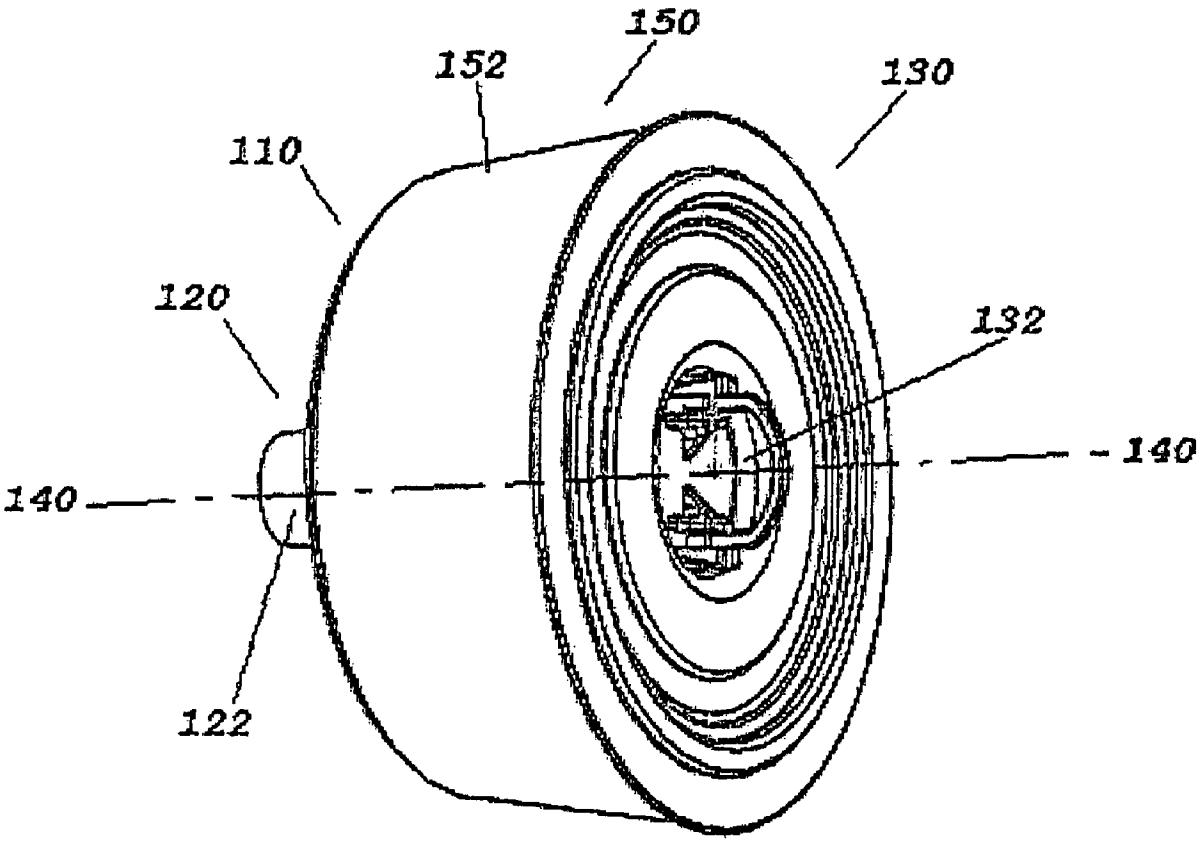
FIG. 1 (PRIOR ART)
FIG. 1 is an earlier invention by the same inventor for painting surface corners, exemplifying prior art inventions.

Referring now to FIG. 1, it may be seen that a paint roller of the prior art adapted for painting surface corners generally comprises a frustoconically-shaped applicator 110 with two opposite ends, 120, 130. One of these ends has a coupler 122 while the other end 130 has a planar cross-section larger planar cross-section of the end 120 with the coupler 122. The coupler end 120 is disposed centrally relative to the planar cross-sections of both ends 120, 130 and permits the applicator to rotate about an axis 140.

An external surface 150 joins the two ends and a paint-absorbable member 152 is mounted to the external surface of the applicator. Paint may be introduced via a closable inlet 132 into a chamber formed by the external surface 152 and the two ends 120, 130. The paint then permeates the perforations (not shown) in the external surface to the paint-absorbable member 152.

Alternatively, in other similar inventions without a chamber or reservoir for the paint, these inventions may simply be dipped into a container of paint to charge the paint-absorbable member. In all paint rollers, as the applicator is rotated or rolled onto the surface, paint is deposited onto the surface.

However, as explained above, paint rollers of the prior art may permit excessive paint to be applied while they may not apply paint precisely at surface corners, or are able to handle uneven or rough surfaces well.

Figure 2:
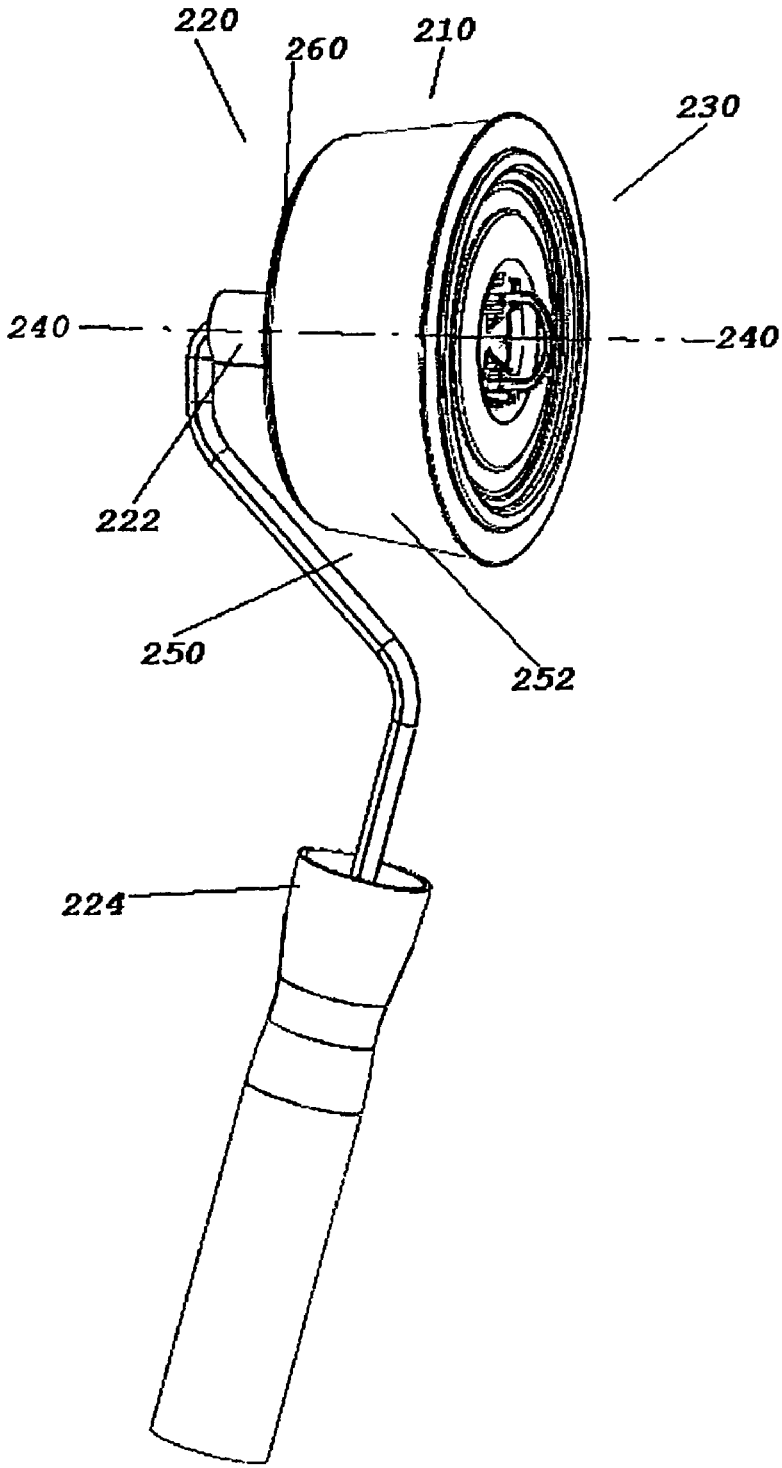
FIG. 2 is an elevational view of one embodiment of the present invention showing the main elements.

The inventive features of the present invention can overcome, or at least alleviate these problems (FIG. 2). The following elements of the present invention are similar to the prior art. The present invention is a paint roller comprising a frustoconically-shaped applicator 210 with two opposite ends: a coupler end 220, and a distal end 230.

The coupler end has a coupler 222 that fits a handle 224 while the distal end 230 has a planar cross-section substantially different (that is, either smaller or larger than) than that of the planar cross-section of the coupler end 220. The coupler 222 is disposed centrally relative to the planar cross-sections of both ends 220, 230 and permits the applicator to rotate about an axis 240.

An external surface 250 joins the two ends and a paint-absorbable member 252 is mounted to the external surface of the applicator. The present invention described thus far resembles paint rollers of the prior art. In the preferred embodiment of the present invention, the planar cross - section of the distal end 230 is larger than the planar cross-section of the coupler end 220 to form the frustoconically-shaped applicator. It will be appreciated that a paint applicator possessing the elements of present invention but with the planar cross-section of the distal end smaller than that of the coupler end will also come within the scope of the present invention.

However, there are two sets of elements in the present invention that are novel and inventive over the prior art. To prevent excessive force from being applied and consequently squeezing out too much paint from the paint-absorbable member 252, a circular integral guard 260 is disposed at the coupler end 220 of the applicator.

Figure 3B:
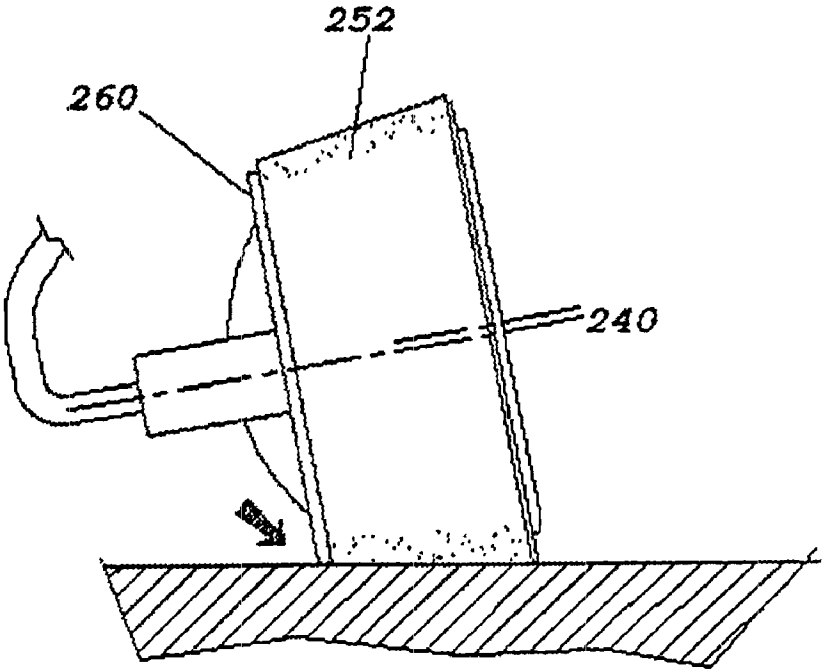
FIGS. 3A and 3B show how the integral guard prevents excessive force from being applied.
Figure 3A:
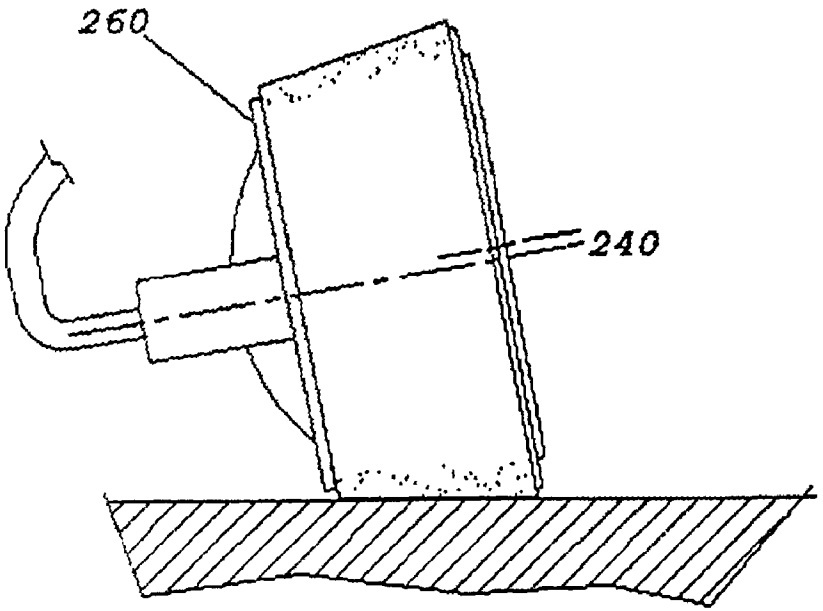

The diameter of this circular integral guard is carefully predetermined such that the paint-absorbable member is not unduly compressed during application of the paint. In FIG. 3, the longitudinal cross-sectional views of the invention shows how the integral guard 260 can limit the compression of the paint-absorbable member 252. Under correct use, a normal application force will not cause the integral guard 260 to contact the surface to be painted (FIG. 3A). Should an excessive force be applied by the user, the edge of integral guard will come into contact with the surface being painted (FIG. 3B) and prevent the paint absorbable member 252 from being overly compressed.

In paint rollers of the prior art not possessing this novel element, the paint-absorbable member may be over-compressed, allowing an undesirable amount of paint to be deposited. The diameter of the integral guard has to be carefully pre-determined through experimentation: it has to be sufficiently large to prevent excessive compression of the paint-absorbable surface while not so large as to interfere with the painting of the surface. Factors such as the size of the applicator, and the thickness and type of paint absorbable member used have to be taken into consideration.

To permit the applicator to accommodate uneven or rough surfaces, the applicator of the present is able to move eccentrically about the axis 240. This bit of eccentric rotation allows the applicator to accommodate uneven or rough surfaces.

Figure 4:
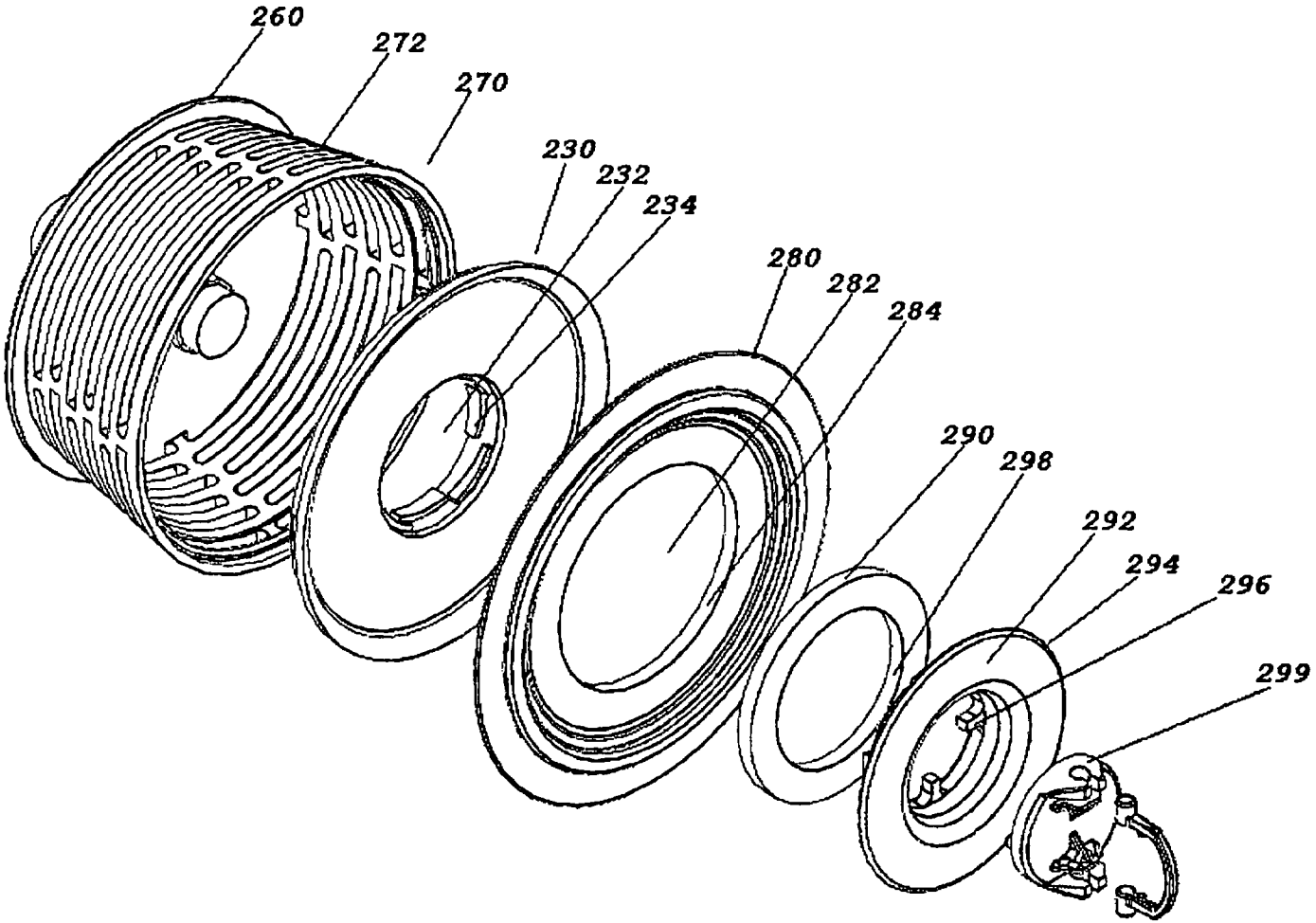
FIG. 4 is an exploded view of one embodiment of the present invention.

The eccentric rotation of the applicator is achieved by a novel set of elements, best seen in the exploded view of the first embodiment of the present invention incorporating a chamber 270 or reservoir to contain paint (FIG. 4).

The chamber is accessible by means of a closable inlet 232, of a fixed diameter, in the distal end 230. A rolling guide 280 with a central orifice 282 of diameter larger than the inlet diameter is disposed coaxially over the distal end 230 of the applicator. A resilient means 290 is radially disposed about the center of the rolling guide 280. In this preferred embodiment, the resilient guide is made of a suitable material such as elastomer, and is shaped like a washer -like perforated disk as shown in FIG. 4.

The circumference of the resilient means coacts with the rolling guide as the resilient means contacts the circular wall 284 that forms the central orifice 282 of the rolling guide 280. The resilient means 290 is held in place by the flange 292 of a detachable retainer 294 that secures to the distal end 230. This securing is possible as the detachable retainer 294 has engagement lugs 296 that engage complementary lugs 234 in the internal walls of the inlet 232. The wall 298 of the internal diameter of the resilient means 290 contacts the external wall of the retainer 294 without interfering with the action of the engagement lugs 296.

To use this embodiment of the present invention, paint is introduced into the reservoir 270 through the closable inlet 232 and the retainer 294. The inlet is then closed with a cap 299 that reversibly engages the retainer 294 such that a liquid-tight seal is achieved. The paint then flows through perforations 272 in the external surface to permeate the paint-absorbable member (not shown for clarity).

A person skilled in the art will appreciate that the presence of the resilient means sandwiched between the rolling guide and the retainer 294 allows the rolling guide to move eccentrically relative to the axis of the applicator, within a certain range of motion.

Figure 6:
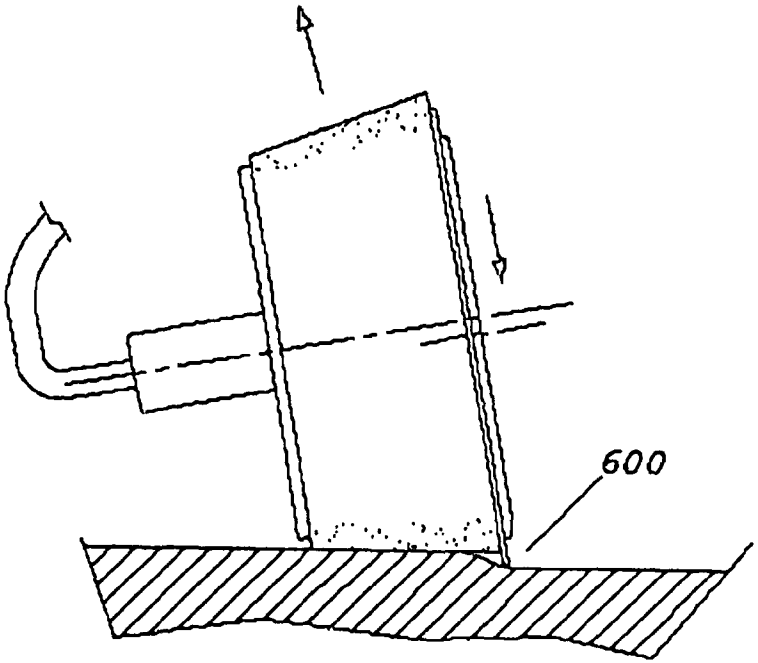
FIG. 6 shows how the present invention is able to accommodate uneven surfaces.
Figure 5:
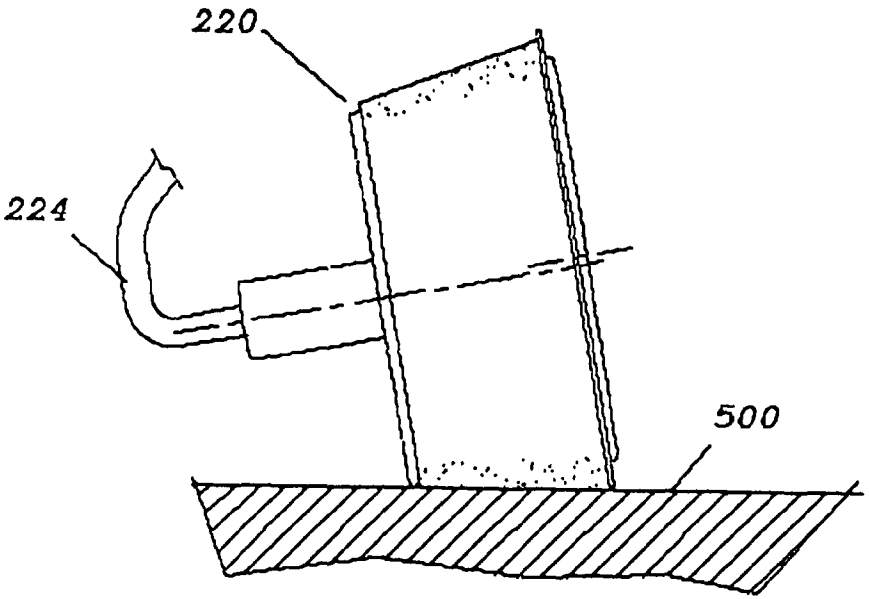

With the present invention, paint may be applied to a substantially even surface 500 by the user in the usual manner by holding the handle (not shown) connected to the shaft 224 which is in turn connected to the coupler end 220 (FIG. 5). As the roller is rolled over the surface to be painted, the paint-absorbable member and the rolling guide come into contact with the surface to be painted. As the roller encounters uneven or rough patches 600 on the surface (FIG. 6), it is able to automatically accommodate such patches by being able to rotate eccentrically relative to the rolling guide to compensate for the uneven surface 600. The arrow heads in FIG. 6 indicate the movements of these rolling guide and corner roller and the axis lines show that the axis of the rolling guide and the axis of the corner roller not coinciding when the roller is accommodating the uneven surface.

Under normal use, the integral guard 260 at the coupler end 220 does not come into contact with the surface being painted. As the integral guard 260 does not contact the surface under normal usage, it functions differently from the shields or barriers of paint rollers of the prior art. However, a novice user may apply excessive force when using the paint roller. When this happens, the integral guard 260 contacts the surface and prevents the paint-absorbable member from being excessively compressed (FIG. 3).

Another embodiment of the present invention does not provide a chamber or reservoir for paint (figure not shown) and the user must periodically charge the paint-absorbing member with paint by dipping the applicator into a container of paint, or by rolling it in paint held in a pan.

In that embodiment, there is no inlet and the retainer is secured by simply engaging its lugs with complementary members in the distal end of the applicator. Other elements of the invention enabling the eccentric rolling of the rolling guide. The roller may then be used like any other corner roller of the prior art without a paint reservoir.

The person skilled in the art will appreciate that while only a few embodiments of the present invention have been described, it should be understood that these embodiments are only illustrative and do not limit the invention. Many variations possible under the scope of the present invention. These include variations in handle shape, coupler function, means of detachably engaging the retainer, closable inlet, choice of material for the paint-absorbing member, and form of the resilient means.

Figure 8:
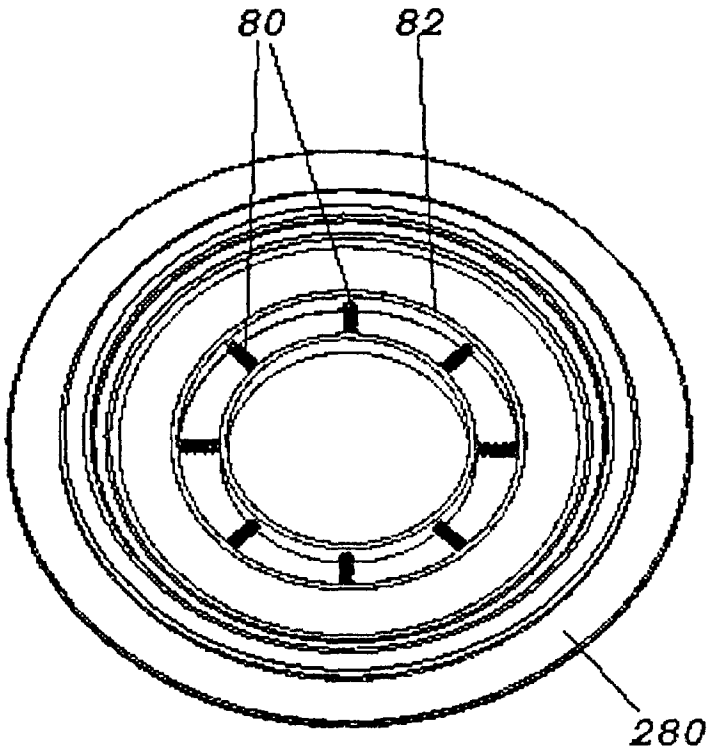
FIG. 7 and FIG. 8 show variations of the resilient means that can be used.
Figure 7:
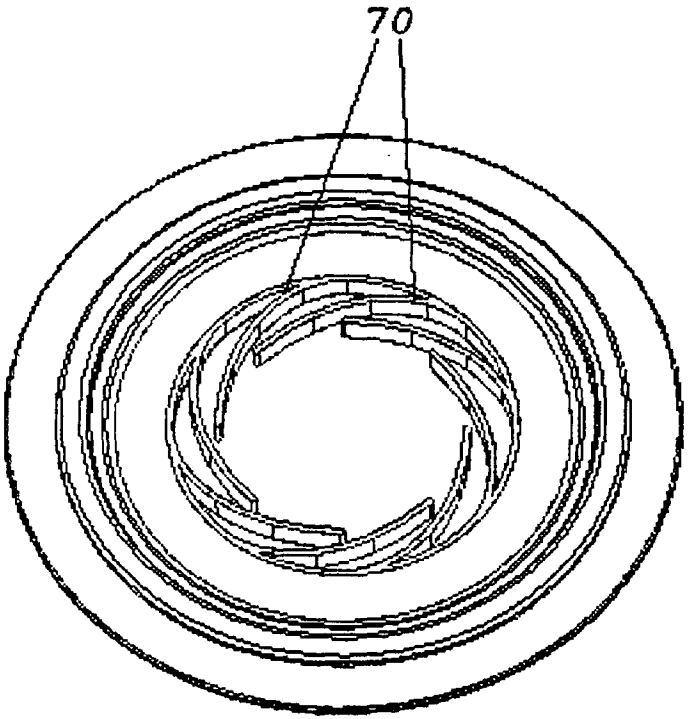

While the preferred embodiment of the resilient means is that of a washer-like form made of elastomeric materials, other embodiments of the resilient means are possible (FIGS. 7 & 8). These include a plurality of curved "fingers" 70 radiating from the wall of the central orifice of the rolling guide coacting against the retainer wall (FIG. 7). Alternatively, instead of curved fingers, a plurality of coil springs 80 coacting on a flexible circular wall 82 may be used to surround the retainer.

A person skilled in the art will appreciate that the present invention may be made by injection-molding one or more suitable plastic materials. While the integral guide may be molded as one piece with the applicator, it is functionally-distinct from the coupler end.

With such an invention, painting of surface corners is made much easier. No preparation such as temporarily shielding the edge of the corner with masking tape to prevent the user from inadvertently painting over the edge is needed. Other conventional techniques to prepare the surface, such as cleaning or sanding it, may be done before applying the paint.

The method of using the present invention therefor comprises using an improved corner roller, removing the cap of the closable inlet, filling the reservoir with paint of the desired color, securely replacing the cap, and waiting a short while for the paint to permeate to the paint absorbable surface. Thereafter, the corner roller may then be rolled on the surface to lightly compress the paint absorbable surface to release paint in a thin, even coat, using the rolling guide as a guide as necessary.

Excessive force during use is prevented by the integral guard and uneven surfaces may be painted without any prior preparation if desired.

In one aspect, the present invention comprises a frustoconically-shaped paint applicator with an integral guard for preventing excessive force from being exerted, and a rolling guide that allows uneven surfaces to be painted.

In another aspect, the present invention provides a method of using such an invention to paint corner surfaces without having to shield the edges where painting is not desired. Uneven surfaces may also be quickly painted without undue preparation. The present invention can overcome, or at least alleviate, the problems of the prior art.

It will be appreciated that although one preferred embodiment has been described in detail, various modifications and improvements can be made by a person skilled in the art without departing from the scope of the present invention.

The invention claimed is:

1. A paint roller for applying paint onto a surface comprising:

a frustoconically-shaped applicator having:

a coupler end;

a distal end opposite the coupler end;

an external surface between the coupler end and the distal end; and a paint-absorbable member;

the paint roller further comprising:

a circular integral guard disposed at the coupler end; and a rolling guide disposed at the distal end, wherein a resilient means radially disposed about a centre of the rolling guide enables the rolling guide to move eccentrically about an axis of the applicator.

2. The paint roller of claim 1, wherein a planar cross-section of the coupler end has a different size than the planar cross-section of the distal end.

3. The paint roller of claim 1, wherein the frustoconically-shaped applicator further comprises a chamber defined by the coupler end, the distal end and the external surface join the coupler and distal ends, and the chamber further has a plurality of perforations.

4. The paint roller of claim 3, wherein the chamber is accessible by a closable inlet.

5. The paint roller of claim 1, wherein the coupler end permits rotation of the paint applicator about an axis.

6. The paint roller of claim 1, wherein a diameter of the integral guard is predetermined to allow the circular integral guard to contact the surface only when excessive force is used to apply paint.

7. The paint roller of claim 1, wherein the resilient means is held in place by a retainer.

8. The paint roller of claim 7, wherein the resilient means is sandwiched between the rolling guide and the retainer.

9. The paint roller of claim 7, wherein the resilient means comprises an elastomeric material and is shaped like a washer-shaped disk.

10. The paint roller of claim 7, wherein the resilient means comprises a plurality of curved fingers radiating from a wall of a central orifice of the rolling guide and coacting against a retainer wall.

11. The paint roller of claim 7, wherein the resilient means comprises a plurality of coil springs coacting on a flexible circular wall.

* * * * *